US009150025B2

(12) United States Patent
Takeuchi et al.

(10) Patent No.: US 9,150,025 B2
(45) Date of Patent: Oct. 6, 2015

(54) LIQUID EJECTING APPARATUS

(71) Applicant: SEIKO EPSON CORPORATION, Tokyo (JP)

(72) Inventors: Hiroshi Takeuchi, Matsumoto (JP); Hiroyuki Yoda, Shiojiri (JP); Kenji Oshima, Minowa-machi (JP); Yoshisada Aoki, Azumino (JP); Satoshi Shimizu, Shiojiri (JP); Kazutoshi Sakamoto, Shiojiri (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/381,543

(22) PCT Filed: Feb. 27, 2013

(86) PCT No.: PCT/JP2013/001187

§ 371 (c)(1),
(2) Date: Aug. 27, 2014

(87) PCT Pub. No.: WO2013/128924

PCT Pub. Date: Sep. 6, 2013

(65) Prior Publication Data

US 2015/0054890 A1 Feb. 26, 2015

(30) Foreign Application Priority Data

Feb. 29, 2012 (JP) ..... 2012-043516
Mar. 28, 2012 (JP) ..... 2012-074292

(51) Int. Cl.

| | |
|---|---|
| ***B41J 2/175*** | (2006.01) |
| ***B41J 29/02*** | (2006.01) |
| ***B41J 13/10*** | (2006.01) |
| ***B41J 29/13*** | (2006.01) |
| ***B41J 11/00*** | (2006.01) |

(52) U.S. Cl.

CPC ..... *B41J 2/17523* (2013.01); *B41J 2/175* (2013.01); *B41J 2/17509* (2013.01); *B41J 11/0045* (2013.01); *B41J 13/106* (2013.01); *B41J 29/02* (2013.01); *B41J 29/13* (2013.01)

(58) Field of Classification Search

USPC ..... 347/85

See application file for complete search history.

(56) References Cited

U.S. PATENT DOCUMENTS

2011/0298873 A1* 12/2011 Katsuyama et al. ..... 347/86

FOREIGN PATENT DOCUMENTS

| | | |
|---|---|---|
| CN | 2825289 | 10/2006 |
| TW | 538909 | 6/2003 |

OTHER PUBLICATIONS

PCT/JP2013/001187, International Search Report dated Apr. 9, 2013 (4 pages).

*Primary Examiner* — Stephen Meier
*Assistant Examiner* — Alexander D Shenderov
(74) *Attorney, Agent, or Firm* — Workman Nydegger

(57) ABSTRACT

An arrangement path of a tube arranged between an ink tank and a carriage is optimized in a case where the ink tank is arranged in an outer portion or the like of an ink jet printer main body.

A liquid ejecting apparatus 1 includes a liquid ejecting apparatus main body 2 that ejects a liquid from a liquid ejecting head which is mounted on a carriage, a liquid accommodating body 110 that is arranged in an external area or the like of the liquid ejecting apparatus main body 2, and liquid supply tubes 120 that are arranged between the liquid accommodating body 110 and the carriage. The liquid ejecting apparatus further includes a paper discharge frame that is arranged along a scanning direction of the liquid ejecting head on a further forward side than the liquid ejecting head. A part of the liquid supply tubes 120 is fixed to a frame member paper discharge frame.

16 Claims, 11 Drawing Sheets

LIQUID EJECTING APPARATUS

TECHNICAL FIELD

The present invention relates to a liquid ejecting apparatus that ejects a liquid from a liquid ejecting head which is mounted on a carriage toward a recording medium.

BACKGROUND ART

An ink jet printer is widely known as a liquid ejecting apparatus that ejects a liquid from a liquid ejecting head to a recording medium.

The ink jet printer includes a carriage, and a recording head that is mounted on the carriage. Printing is performed on recording paper when ink (liquid) is ejected from a nozzle formed on the recording head while the carriage is in a scanning movement with respect to the recording paper (recording medium).

In some ink jet printers, an ink cartridge that supplies the ink to the recording head is mounted on the carriage (on carriage type). The ink cartridge is detachably mounted on the carriage.

In the on carriage type ink jet printer, the ink capacity of the ink cartridge is limited. In a case where relatively voluminous printing is to be performed, the ink cartridges have to be frequently exchanged, which results in an increase in running cost.

An apparatus that supplies the ink from a large ink tank, which is arranged out of the ink jet printer, toward the carriage has been proposed. An attachment, instead of the ink cartridge, is mounted on the carriage. The ink is supplied from the ink tank to the attachment via a tube. The voluminous printing is possible in this manner (refer to PTL 1).

CITATION LIST

Patent Literature

PTL 1: Specification of Chinese Examined Utility Model Registration Application Publication No. 2825289

SUMMARY OF INVENTION

Technical Problem

According to the technique described in PTL 1, the large ink tank is arranged on a side in an outer portion of an ink jet printer main body. The tube is laid across the carriage from a side portion of the ink jet printer main body. A part of the tube is fixed to a tube holding member that is mounted on the ink jet printer main body.

The tube holding member is fixed on a paper feed unit side of the ink jet printer main body. Accordingly, when the carriage is in the scanning movement, a flexible cable or the like that is laid across the carriage from the paper feed unit side of the ink jet printer main body and the tube may interfere with each other.

An object of the invention is to optimize an arrangement path of the tube arranged between the ink tank and the carriage in a case where the ink tank is arranged in the outer portion or the like of the ink jet printer main body.

Solution to Problem

According to the invention, there is provided a liquid ejecting apparatus including a liquid ejecting apparatus main body that ejects a liquid from a liquid ejecting head which is mounted on a carriage toward a recording medium, a liquid accommodating body that is arranged in an external area of the liquid ejecting apparatus main body, and a plurality of liquid supply tubes that guide the liquid which is fed from the liquid accommodating body where the liquid is accommodated toward the liquid ejecting head and include a deforming movable portion which is deformed in response to the movement of the carriage, in which the liquid ejecting apparatus further includes a paper discharge frame that is arranged along a scanning direction of the liquid ejecting head on a further downstream side of the recording medium in a transport direction than the liquid ejecting head, a part of the liquid supply tubes is fixed to the paper discharge frame, and the liquid supply tubes are deformed in response to the movement of the carriage.

According to the invention, the liquid ejecting apparatus further includes a tube holding member with a base end portion fixed to the paper discharge frame and a tip end portion where a part of the liquid supply tubes is held.

The liquid supply tubes are formed from a plurality of tubes, and the liquid supply tubes are arranged in a horizontal direction and fastened by the tip end portion.

The liquid supply tubes are formed from a plurality of tubes, and the liquid supply tubes are arranged in a perpendicular direction and fastened by the tip end portion.

The liquid supply tubes are parallel connection tubes where the plurality of tubes are connected in parallel.

The tip end portion of the tube holding member is formed in parallel with the paper discharge frame.

The base end portion of the tube holding member has an extending site along the paper discharge frame, and the extending site coincides with an end portion of the paper discharge frame.

The paper discharge frame further includes a bottom surface that faces the recording medium and a front surface toward the downstream side in the transport direction, and the base end portion of the tube holding member is formed to be shaped to be fixed in close contact to the bottom surface and the front surface of the paper discharge frame.

The paper discharge frame further includes a front surface toward the downstream side in the transport direction, and the base end portion of the tube holding member is formed into a flat plate shape to be fixed in close contact only to the front surface of the paper discharge frame.

The paper discharge frame further includes a groove portion with an open upper surface, and the base end portion of the tube holding member is accommodated in the groove portion to be movable in the scanning direction.

The base end portion of the tube holding member is pressed against the groove portion and is fixed to the paper discharge frame by a screw which is mounted on the groove portion.

The liquid ejecting apparatus further includes an internal space on the further downstream side of the recording medium in the transport direction than the paper discharge frame.

The liquid supply tubes are outward from a concave portion that is formed in an upper surface of the liquid ejecting apparatus.

The tube holding member is mounted on the concave portion.

DESCRIPTION OF EMBODIMENTS

First Embodiment

A multifunction printer 1 according to a first embodiment of the invention will be described.

Hereinafter, in each of the accompanying drawings, a transport direction (vertical scanning) of recording paper P is referred to as an X direction, a scanning direction (horizontal direction) of a carriage 81 is referred to as a Y direction, and a perpendicular direction is referred to as a Z direction.

Idiomatically, a downstream side (+X direction) of the recording paper (recording medium) P in the transport direction is referred to as front, and an upstream side (−X direction) is referred to as back. In the Y direction, a +Y direction is referred to as a left side, and a −Y direction is referred to as a right side. In the Z direction, a +Z direction is referred to as up, and a −Z direction is referred to as down.

Figure 1:
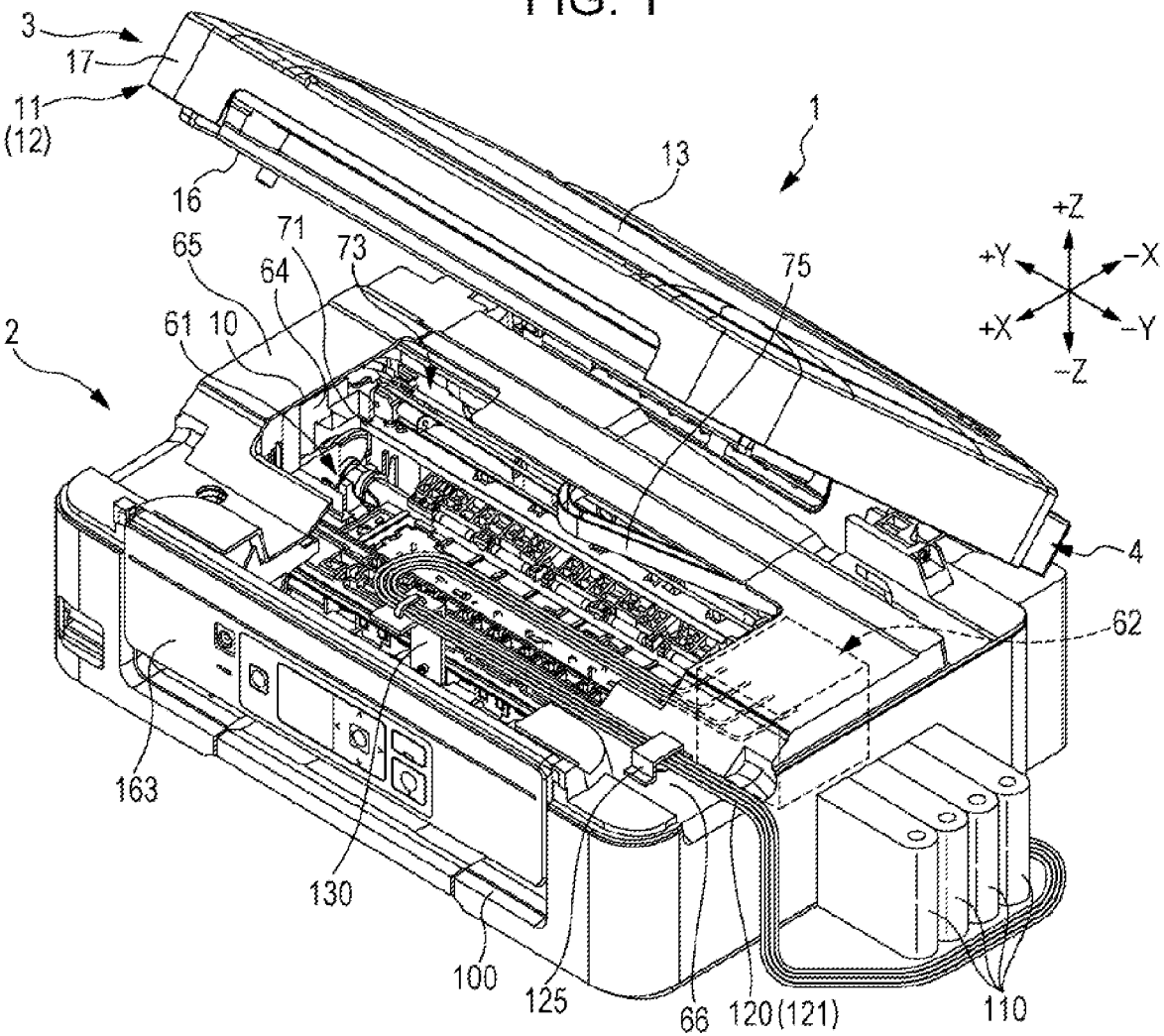
FIG. 1 is an external perspective view of a multifunction printer 1 (at a time when a scanner unit 3 is in an open state) according to a first embodiment.

FIG. 1 is an external perspective view of the multifunction printer 1 (at a time when a scanner unit 3 is in an open state) according to the first embodiment.

The multifunction printer (liquid ejecting apparatus) 1 includes a printer unit 2 that is an apparatus main body and the scanner unit 3 that is an upper unit which is arranged in an upper portion of the printer unit 2, which are integrally provided. As illustrated in FIG. 1, the multifunction printer 1 includes ink containers (liquid accommodating bodies) 110, which store ink, in an outer portion of the printer unit 2.

The scanner unit 3 is rotatably supported by the printer unit 2 via an opening/closing unit 4 in a rear end portion, and covers the upper portion of the printer unit 2 in an openable and closeable manner.

As illustrated in FIG. 1, an upper surface opening portion 10 of the printer unit 2 is exposed when the scanner unit 3 is lifted in a direction of rotation. In this manner, an inner portion of the printer unit 2 is exposed from the upper surface opening portion 10.

The upper surface opening portion 10 is closed by the scanner unit 3 when the scanner unit 3 is lowered in the direction of rotation and is mounted on the printer unit 2.

Prevention of paper jamming or the like is possible when the scanner unit 3 is lifted and the upper surface opening portion 10 is exposed in this manner.

The scanner unit 3 has a resinous upper frame 11, an image reading unit 12 that is accommodated in the upper frame 11, and an upper lid 13 that is rotatably supported by an upper portion of the upper frame 11.

The component of the opening/closing unit 4 on the scanner unit 3 side is disposed in a rear end portion of the upper frame 11.

The upper frame 11 has a box-shaped lower case 16 that accommodates the image reading unit 12, and an upper case 17 that covers a top surface of the lower case 16.

A manuscript mounting plate formed of glass is widely arranged (not illustrated) in the upper case 17. A reading medium is mounted, with a reading surface facing downward, on the manuscript mounting plate.

The image reading unit 12 that is accommodated in the lower case 16 has a line sensor type sensor unit or the like (not illustrated). The sensor unit has an image sensor (sensor unit) that is a charge coupled device (CCD) type line sensor extending in the X direction, and reciprocates in the Y direction. In this manner, an image of the reading medium (manuscript) on the manuscript mounting plate is read.

A complementary metal oxide semiconductor (CMOS) type line sensor may be used as the image sensor.

The printer unit (liquid ejecting apparatus main body) 2 has a transport unit 61 that feeds a sheet of the recording paper P along a transport path R, a printing unit 62 that is arranged above the transport path R and performs ink jet type printing processing on the recording paper P, a panel type operation unit 63 that is arranged on a front surface, an apparatus frame 64 on which the transport unit 61, the printing unit 62, and the operation unit 63 are mounted, and an apparatus housing 65 that covers the transport unit 61, the printing unit 62, the operation unit 63, and the apparatus frame 64.

Figure 2:
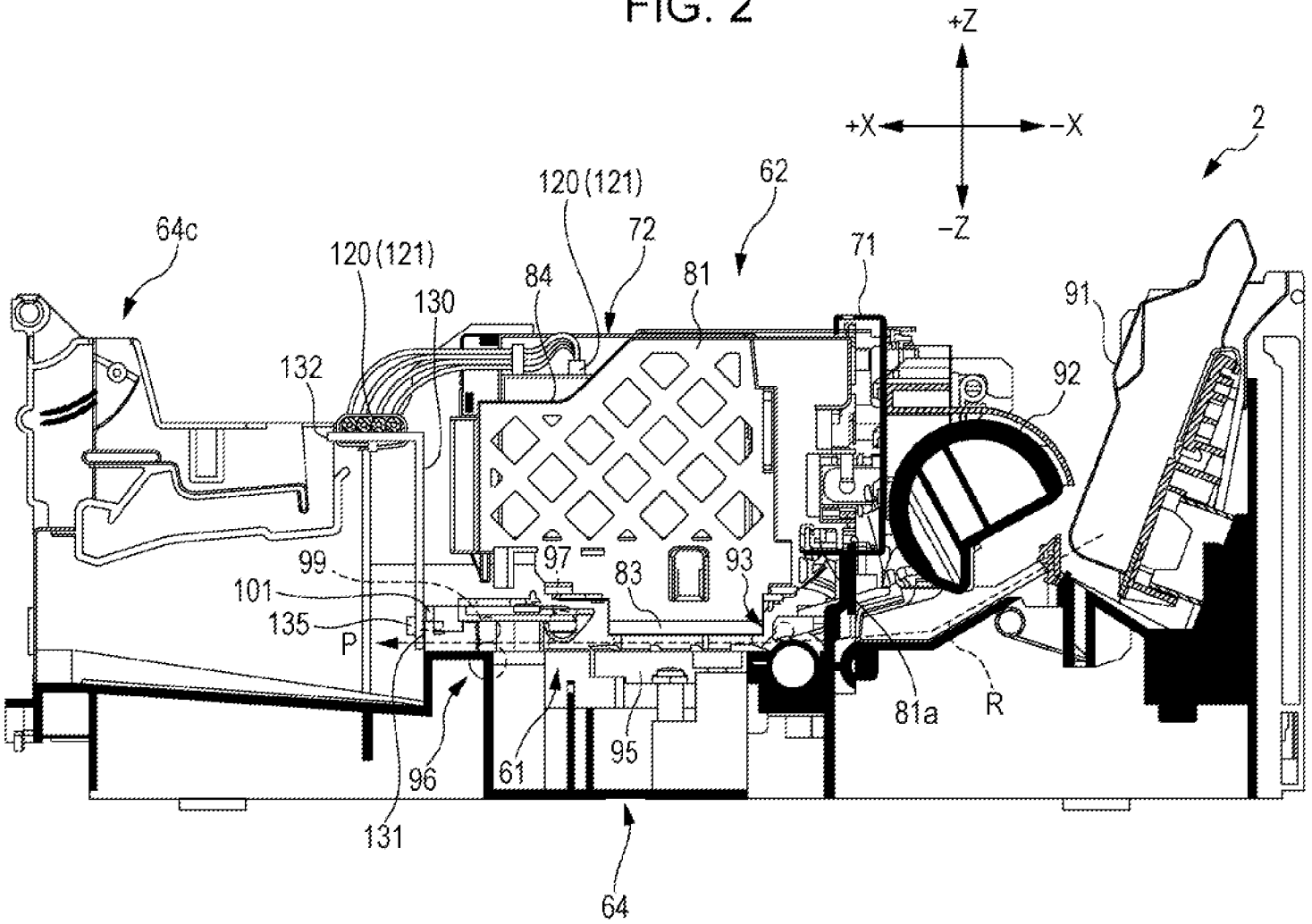
FIG. 2 is a side sectional view illustrating an internal structure of a printer unit 2 and an arrangement path of a tube 120.

FIG. 2 is a side sectional view illustrating an internal structure of the printer unit 2 and an arrangement path of a tube 120.

The printing unit 62 has a guide frame 71 formed of sheet metal that is supported by the apparatus frame 64 and extends in full width in the Y direction, a carriage unit 72 that is reciprocally supported by the guide frame 71, and a carriage moving mechanism 73 (refer to FIG. 1) that allows the carriage unit 72 to reciprocate along the guide frame 71.

The carriage unit 72 has a box-shaped carriage 81 that is reciprocally supported by the guide frame 71 via an engaging slider portion 81*a*, an ink jet head 83 that is integrally incorporated into a lower surface of the carriage 81, and four ink cartridge adapters 84 that are detachably accommodated in the carriage 81.

The ink jet head (liquid ejecting head) 83 has four nozzle columns (not illustrated) that discharge ink droplets of four colors. The four ink cartridge adapters 84 that store the ink of the four colors are mounted on the carriage 81. The four ink cartridge adapters 84 are directly connected to an upper surface side to the ink jet head 83.

The ink is supplied to the ink cartridge adapters 84 from the ink containers 110 (described later).

The transport unit 61 has a movable paper tray 91 that sets the recording paper P in right alignment, a separation roller 92 that feeds out the recording paper P by separating the recording paper P sheet by sheet from the paper tray 91, a paper feed roller 93 that is positioned on the downstream side of the separation roller 92 and feeds the recording paper P into the printing unit 62 along the transport path R, a medium regulating member 95 that is positioned on the downstream side of the paper feed roller 93 and faces the ink jet head 83, a serrated guide roller 97 that is positioned on the downstream side of the medium regulating member 95, and a paper discharge roller 96 that is positioned on the downstream side of the guide roller 97 and feeds out the recording paper P from an outlet 100 (refer to FIG. 1).

The medium regulating member 95 corresponds to a so-called platen.

The recording paper P that is fed in from the paper tray 91 by the separation roller 92 is intermittently fed in the X direction toward the paper discharge roller 96 on the medium regulating member 95 by the paper feed roller 93 (vertical scanning).

In synchronization with this intermittent feeding, the carriage unit 72 selectively discharges the ink while reciprocating in the X direction (main scanning) to perform desired printing.

A leading edge of the recording paper P that reaches the guide roller 97 beyond the medium regulating member 95 is fed into the paper discharge roller 96 with a cambered state corrected by the guide roller 97.

When the printing is completed, the recording paper P is fed out forward from the outlet 100 by the paper discharge roller 96 in this manner.

Figure 3:
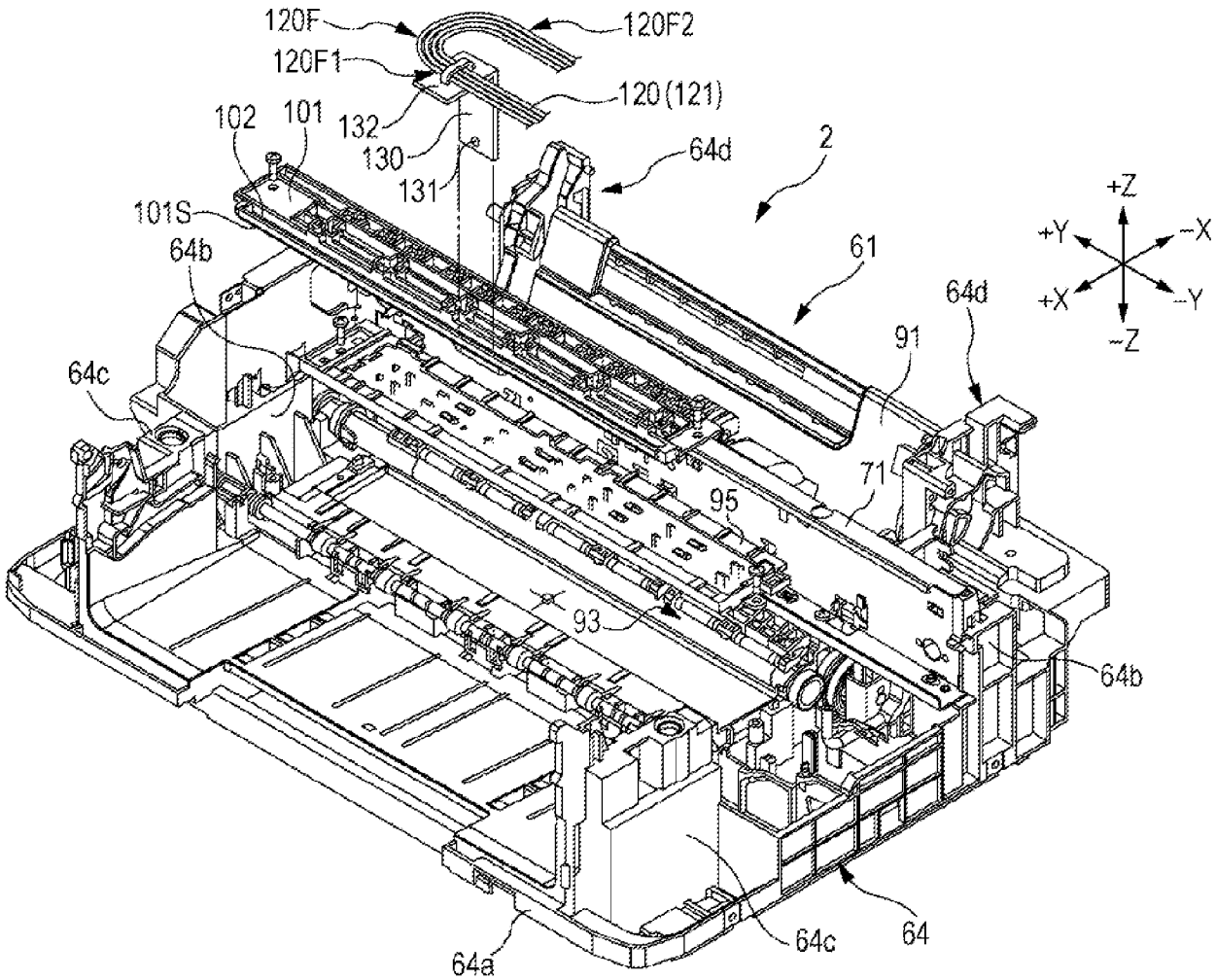
FIG. 3 is an exploded perspective view illustrating the internal structure of the printer unit 2 and the arrangement path of the tube 120.

FIG. 3 is an exploded perspective view illustrating the internal structure of the printer unit 2 and the arrangement path of the tube 120.

Figure 4:
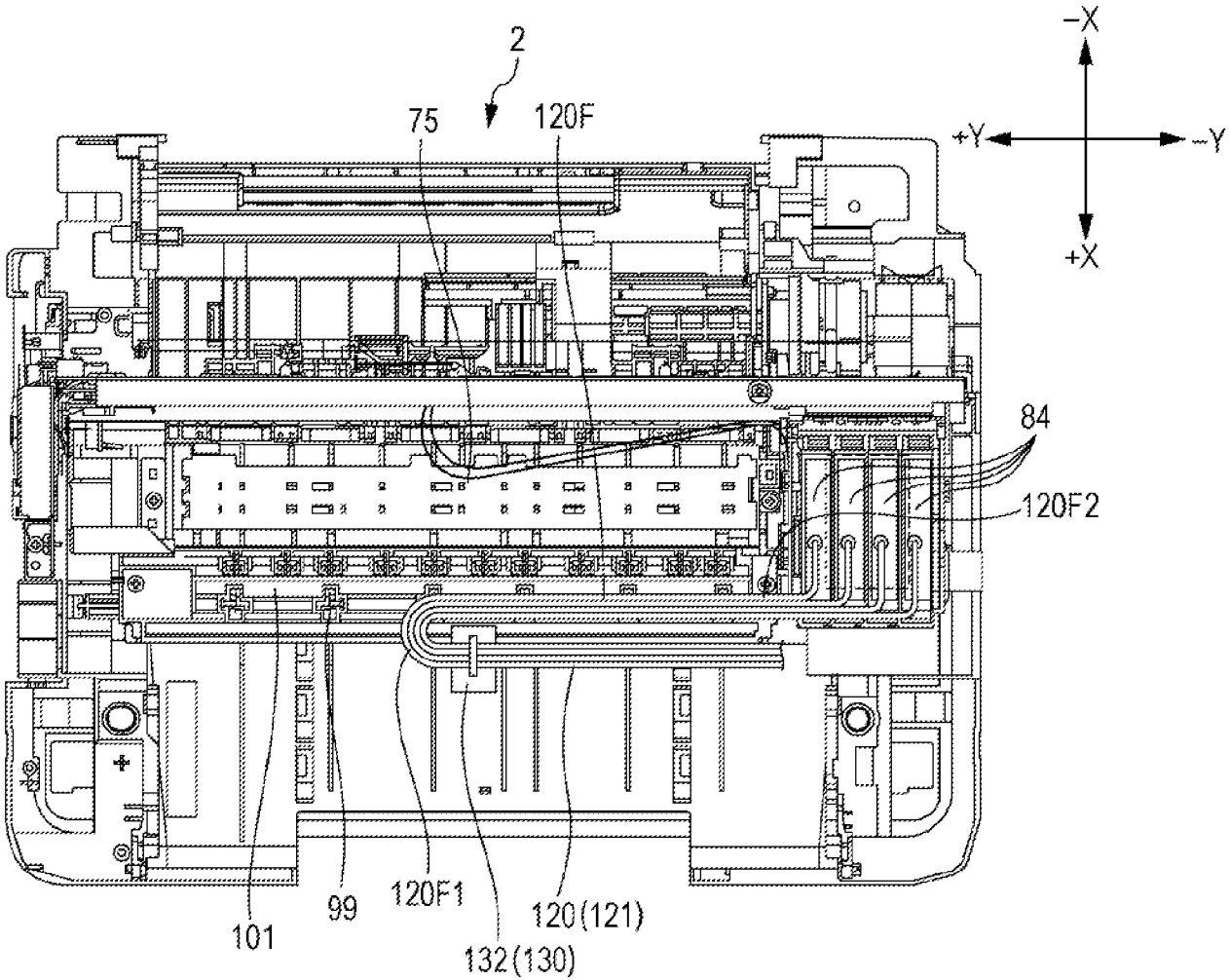
FIG. 4 is a top view illustrating the internal structure of the printer unit 2 and the arrangement path of the tube 120.

FIG. 4 is a top view illustrating the internal structure of the printer unit 2 and the arrangement path of the tube 120.

The apparatus frame 64 is a frame that supports each of the portions of the printer unit 2, and is formed of an integrally molded resin.

The apparatus frame 64 has a base frame portion 64*a*, a pair of right and left side frame portions 64*b*, a pair of right and left front frame portions 64*c*, and a pair of right and left rear frame portions 64*d*.

The pair of right and left side frame portions 64*b* are disposed upright in the base frame portion 64*a*, and support each of the components of the transport unit 61 and the guide frame 71 on both sides.

The pair of right and left front frame portions 64*c* support a front portion of the scanner unit 3 in a front portion of the base frame portion 64*a*, and support the operation unit 63.

The pair of right and left rear frame portions 64*d* support the printer unit 2 in an openable and closeable manner via the opening/closing unit 4 in a rear portion of the base frame portion 64*a*.

The pair of rear frame portions 64*d* are disposed upright to an outer portion of the apparatus housing 65 via a rear portion opening portion that is open to a rear portion of the apparatus housing 65. The component of the opening/closing unit 4 on the printer unit 2 side is formed in the pair of rear frame portions 64*d*.

A paper discharge frame 101 that supports the guide roller 97 and an auxiliary roller 99 is arranged in front portions of the side frame portions 64*b*. The auxiliary roller (roller) 99 is arranged to face the paper discharge roller 96.

The paper discharge frame (paper discharge frame) 101 is arranged on a more frontward (+X direction) side and on a more downward (−Z direction) side than the carriage 81. The paper discharge frame 101 is laid across horizontally along the scanning direction (Y direction) of the carriage 81 between the pair of side frame portions 64*b*.

The four ink containers 110 that store the ink of the four colors are arranged on a side surface side (−Y direction) of the multifunction printer 1 (refer to FIG. 1). The ink accommodation amount of the ink containers 110 is larger than the ink accommodation amount of the ink cartridge adapters 84.

The tube 120, through which the ink that is accommodated in the ink containers 110 is supplied toward the ink cartridge adapters 84, is arranged (piped) between the ink containers 110 and the ink cartridge adapters 84. The tube (liquid supply tube) 120 is formed from four tubes 121 through which the ink of the four colors is supplied.

The tube 120 is fixed to the two places of an upper surface of the printer unit 2 and a tube holding member 130 mounted on the paper discharge frame 101 between the ink containers 110 and the ink cartridge adapters 84.

An area of the tube 120 between the tube holding member 130 and the ink cartridge adapters 84 is a movable area 120F that is bent and deformed due to a scanning movement of the carriage 81.

The tube holding member 130 is a flat plate-shaped member that extends in an up-and-down direction, and is formed, for example, by bending a sheet metal (refer to FIG. 3).

A base end portion 131 that is a lower side end portion of the tube holding member 130 is fixed, by using a screw 135, to a front surface 101*s* of the paper discharge frame 101. A tip end portion 132 that is an upper side end portion of the tube holding member 130 is bent and formed on a horizontal plane.

The tube holding member 130 is arranged at the center of the transport unit 61 in a right-and-left direction. A position of the tip end portion 132 in the Z direction is positioned below (−Z direction) an upper end of the carriage 81. The tube 120 that is formed from the four tubes 121 is held on an upper surface of the tip end portion 132. The four tubes 121 are fastened and held to be parallel in the X direction in the tip end portion 132.

The arrangement path (piping route) of the tube 120 will be described along a direction (direction in which the ink flows) from the ink containers 110 toward the ink cartridge adapters 84 (description will be made in the order of FIG. 1 and FIG. 4).

First, as illustrated in FIG. 1, the tube 120 is laid across to be an arc-shaped path from the ink containers 110 toward an upper surface of the apparatus housing 65. A groove-shaped concave portion 66 that has a groove shape is formed along the Y direction on the upper surface of the apparatus housing 65. The tube 120 is fixed in the groove-shaped concave portion 66 by using a tube fastening/fixing tool 125.

The tube fastening/fixing tool 125 is a member that fastens and fixes all of the four tubes 121, which are arranged in parallel in the groove-shaped concave portion 66, by covering the four tubes 121 from the upper surface side. The tube fastening/fixing tool 125 is formed of a hard resin.

The tube fastening/fixing tool 125 functions such that the tube 120 is not crushed by the scanner unit 3 when the scanner unit 3 is closed. Accordingly, the scanner unit 3 abuts against the tube fastening/fixing tool 125, and thus the scanner unit 3 cannot be closed completely.

Next, as illustrated in FIG. 1, the tube 120 is fixed in the groove-shaped concave portion 66 of the apparatus housing 65 and then is laid across toward the tube holding member 130 from the upper surface opening portion 10. Between the groove-shaped concave portion 66 of the apparatus housing 65 and the tip end portion 132 of the tube holding member 130, the tube 120 is laid across to be a substantially linear path toward the Y direction.

The tube 120 is held in the tip end portion 132 of the tube holding member 130 at the center of the transport unit 61 in the right-and-left direction. The tube 120 is fastened and fixed, by using a fastening band or the like, in the tip end portion 132 of the tube holding member 130.

Further, as illustrated in FIG. 4, the tube 120 is held by the tube holding member 130 and then is arranged, for a moment, toward the +Y direction. Then, the tube 120 is folded back into a U shape and is inverted from the +Y direction into the −Y direction. The tube 120 is folded back into the U shape in the up-and-down direction.

The tube 120, after being inverted into the −Y direction, is fixed onto upper surfaces of the four ink cartridge adapters 84 accommodated in the carriage 81. The tube 120 is fixed, by using a fastening band or the like, onto the upper surfaces of the ink cartridge adapters 84. Then, the four tubes 121 of the tube 120 are respectively connected to the ink cartridge adapters 84.

The area of the tube 120 that is bent into the U shape is the movable area 120F that is bent and deformed due to the scanning movement of the carriage 81. As illustrated in FIG. 2, a fixing side area 120F1 of the movable area 120F that is close to the tube holding member 130 and a moving side area 120F2 of the movable area 120F that is close to the ink cartridge adapters 84 are arranged at substantially the same position or adjacent positions in the X direction. The fixing side area 120F1 is arranged on a more downward side (−Z direction) than the moving side area 120F2. The length of the movable area 120F is adjusted not to inhibit the scanning movement of the carriage 81.

As described above, the tube 120 that is arranged (piped) between the ink containers 110 disposed on the sides of the multifunction printer 1 and the carriage 81 is set in a path through the more forward (+X direction) side than the carriage 81 in the multifunction printer 1 according to the first embodiment. Accordingly, the tube 120 does not interfere with, for example, the flexible cable 75 that is wired from the backward (−X direction) side of the carriage 81 to the ink jet head 85 of the carriage 81.

The tube holding member 130 that supports (holds) one end portion of the movable area of the tube 120 is mounted on the paper discharge frame 101 that is arranged on a more +X direction side than the carriage 81. Accordingly, the tube 120 can be ensured to realize the path through the more +X direction side than the carriage 81.

The tube 120 may be a parallel connection tube in which four tubes are integrated instead of being the four tubes 121. The four tubes 121 are not limited to a case where the four tubes 121 are arranged in parallel. For example, the four tubes 121 may be arranged in two rows, each of which has two of the tubes 121.

The ink containers 110 are not limited to a case where the number of the ink containers 110 is four, and the tube 120 is not limited to a case where the number of the tubes 121 is four. The number of the ink containers 110 may be six, and the number of the tubes 121 of the tube 120 may be six.

A relatively wide space (internal space) is formed between the paper discharge frame 101 and the outlet 100.

Since the tube holding member 130 is mounted on the paper discharge frame 101, the space can be used effectively.

[First Modification Example of Tube Holding Member]

Figure 5:
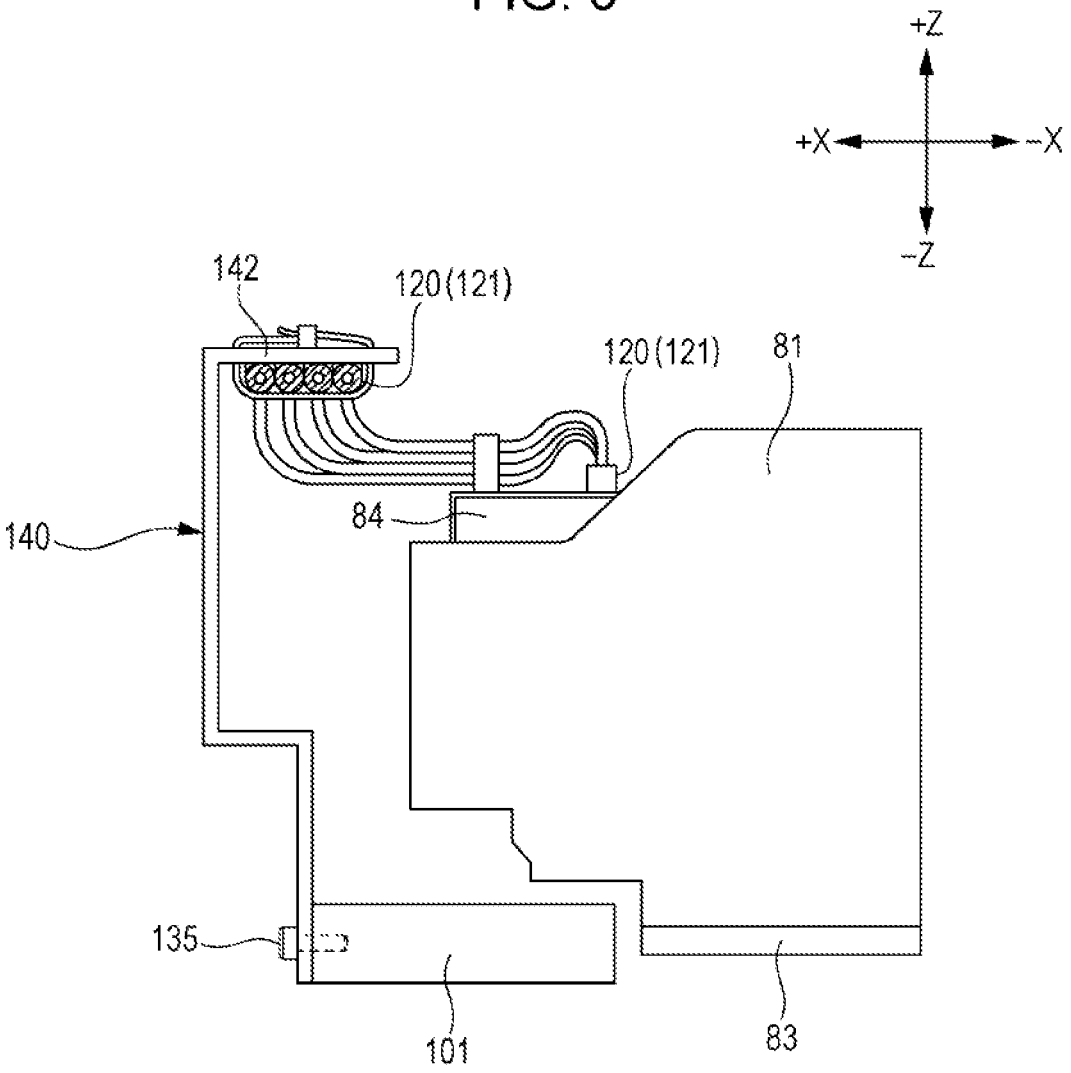
FIG. 5 is a view illustrating a tube holding member 140.

FIG. 5 is a view illustrating a tube holding member 140.

The tube holding member 140 is a modification example of the tube holding member 130. The tube holding member 140 can be used instead of the tube holding member 130. The tube holding member 140 has substantially the same shape as the tube holding member 130.

Unlike in the tube holding member 130, a position of a tip end portion 142 of the tube holding member 140 in the Z direction is positioned above (+Z direction) the upper end of the carriage 81.

The tube 120 is held on a lower surface of the tip end portion 142. The movable area 120F of the tube 120 is folded back into a U shape in the up-and-down direction. A holding side area 120F1 of the movable area 120F that is close to the tube holding member 130 and the moving side area 120F2 of the movable area 120F that is close to the ink cartridge adapters 84 are arranged at substantially the same position or adjacent positions in the X direction. The holding side area 120F1 is arranged on a more upward side (+Z direction) than the moving side area 120F2.

[Second Modification Example of Tube Holding Member]

Figure 6:
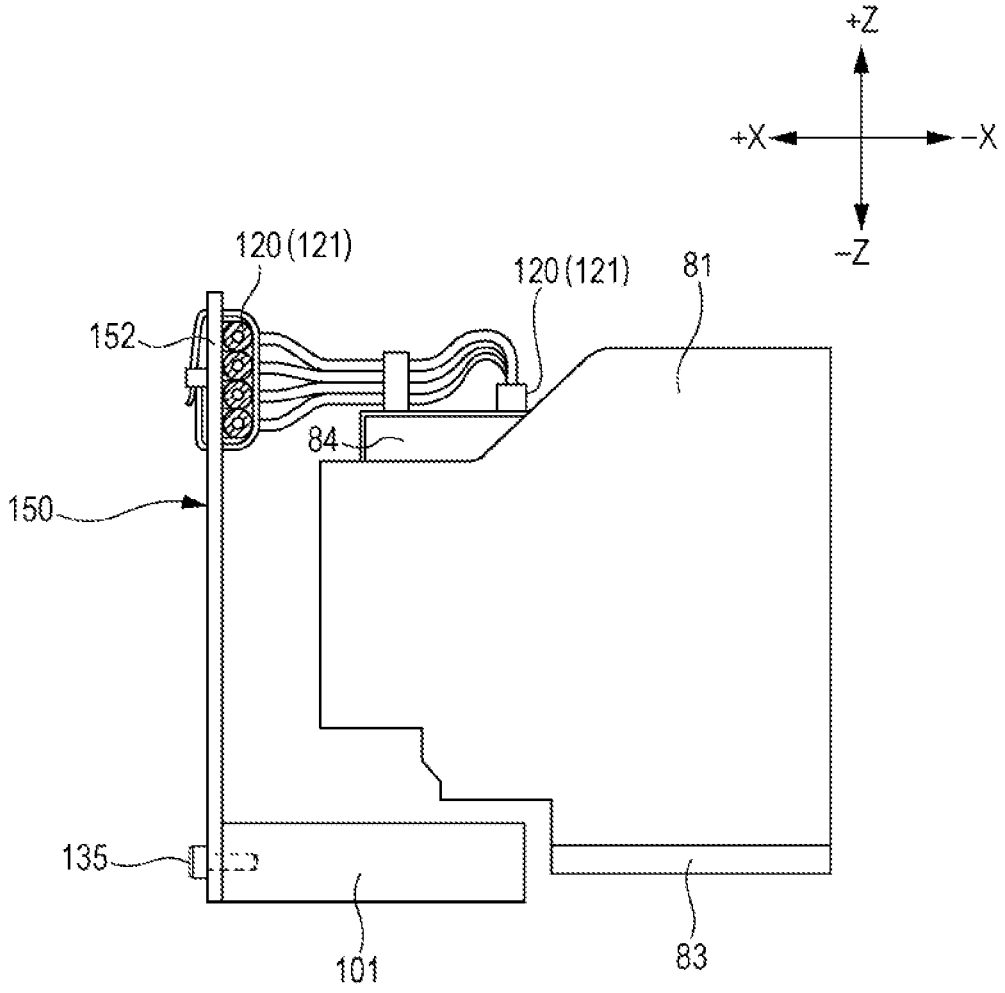
FIG. 6 is a view illustrating a tube holding member 150.

FIG. 6 is a view illustrating a tube holding member 150.

The tube holding member 140 is a modification example of the tube holding member 130. The tube holding member 140 can be used instead of the tube holding member 130.

Unlike in the tube holding member 130, a tip end portion 152 of the tube holding member 150 is formed on a vertical plane. A position of the tip end portion 152 in the Z direction is positioned at substantially the same height as the upper end of the carriage 81.

The tube 120 is held in parallel along a vertical direction in the tip end portion 152. The movable area 120F of the tube 120 is folded back into a U shape in the horizontal direction.

The holding side area 120F1 of the movable area 120F that is close to the tube holding member 130 and the moving side area 120F2 of the movable area 120F that is close to the ink cartridge adapters 84 are arranged at substantially the same position or adjacent positions in the Z direction. The holding side area 120F1 is arranged on a more forward side (+X direction) than the moving side area 120F2.

[Third Modification Example of Tube Holding Member]

Figure 7:
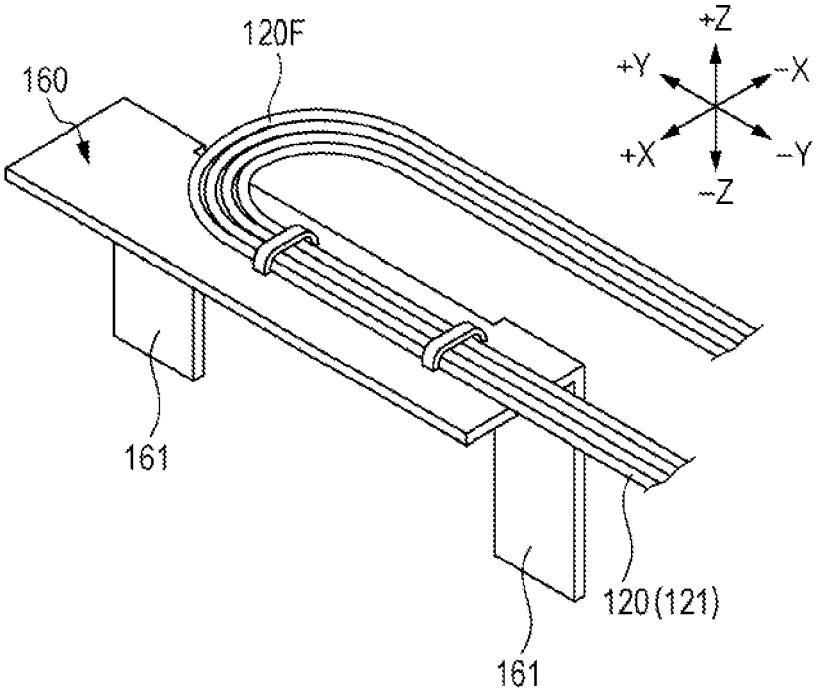
FIG. 7 is a view illustrating a tube holding member 160.

FIG. 7 is a view illustrating a tube holding member 160.

The tube holding member 160 is a modification example of the tube holding members 130, 140, and 150. The tube holding member 160 can be used instead of the tube holding members 130, 140, and 150.

The tube holding member 160 is formed from two base end portions 161 that are disposed upright in the up-and-down direction, and a tip end portion 162 that is laid across horizontally between the two base end portions 161. The tube holding member 160 has the beam-shaped tip end portion 162.

The two base end portions 161 have the same shape as, for example, the base end portion 131 of the tube holding member 130. The tip end portion 162 is arranged in parallel with the paper discharge frame 101.

The tip end portion 162 is formed on a horizontal plane as is the case with the tip end portions 132 and 142. In this case, a position of the tip end portion 162 in the Z direction is set similarly to any one of the tip end portions 132 and 142.

The tip end portion 162 may be formed on a vertical plane as is the case with the tip end portion 162. In this case, a position of the tip end portion 162 in the Z direction is set similarly to the tip end portion 162.

In the tube holding member 160, the tube 120 is arranged in a similar manner to a case where the tube holding members 130, 140, and 150 are used.

In the tube holding member 160, the tip end portion 162 extends in the Y direction, and thus the position where the tube 120 is held is easily adjusted in the Y direction. In this manner, the length of the movable area 120F of the tube 120 and the like are likely to be adjusted.

[Fourth Modification Example of Tube Holding Member]

Figure 8:
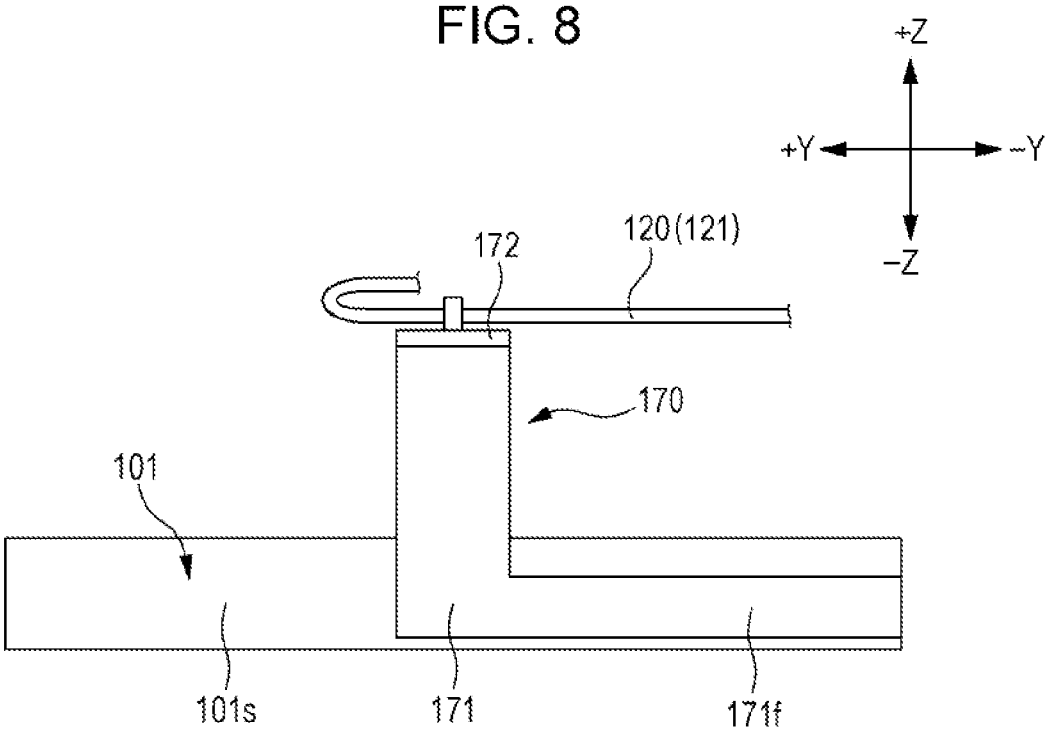
FIG. 8 is a view illustrating a tube holding member 170.

FIG. 8 is a view illustrating a tube holding member 170.

The tube holding member 170 is a modification example of the tube holding members 130, 140, and 150. The tube holding member 170 can be used instead of the tube holding members 130, 140, and 150.

A tip end portion 172 of the tube holding member 170 has the same shape as the tip end portion 132. The tip end portion 172 may have the same shape as the tip end portions 142 and 152.

A base end portion 171 of the tube holding member 170 is formed to have a flat plate shape and to extend in the up direction (+Z direction) and the right direction (−Y direction). The base end portion 171 is formed into an L shape.

An extending site 171*f* of the base end portion 171 that extends in the right direction (−Y direction) extends to an end portion of the paper discharge frame 101, while in close contact with the front surface 101*s* of the paper discharge frame 101, and abuts against the side frame portions 64*b*. The tip end portion 172 of the tube holding member 170 is arranged to coincide with the center of the paper discharge frame 101 in the right-and-left direction.

In the tube holding member 170, the tube 120 is arranged in a similar manner to a case where the tube holding members 130, 140, and 150 are used.

In the tube holding member 170, the tip end portion 172 coincides with the center of the paper discharge frame 101 in the right-and-left direction, and thus a position of the tip end portion 172 in the Y direction does not have to be adjusted. In this manner, the length of the movable area 120F of the tube 120 and the like can be set to be constant.

The length of the extending site 171*f* can be appropriately changed in design according to the type of the tube and the like.

[First Modification Example of Base End Portion]

Figure 9:
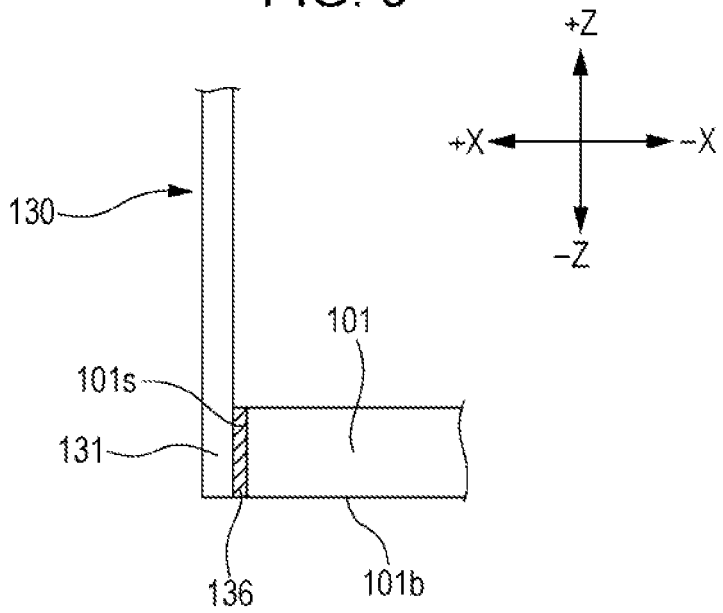
FIG. 9 is a view illustrating a first modification example of a base end portion 131 of a tube holding member 130.

FIG. 9 is a view illustrating a first modification example of the base end portion 131 of the tube holding member 130.

The base end portion 131 of the tube holding member 130 may be fixed in close contact to the front surface 101*s* of the paper discharge frame 101 via an adhesive and a two-sided adhesive tape. In this case, the mounting can be more facilitated than in a case where a screw or the like is used.

A similar fixing method can also be used for the tube holding members 140, 150, 160, and 170.

[Second Modification Example of Base End Portion]

Figure 10:
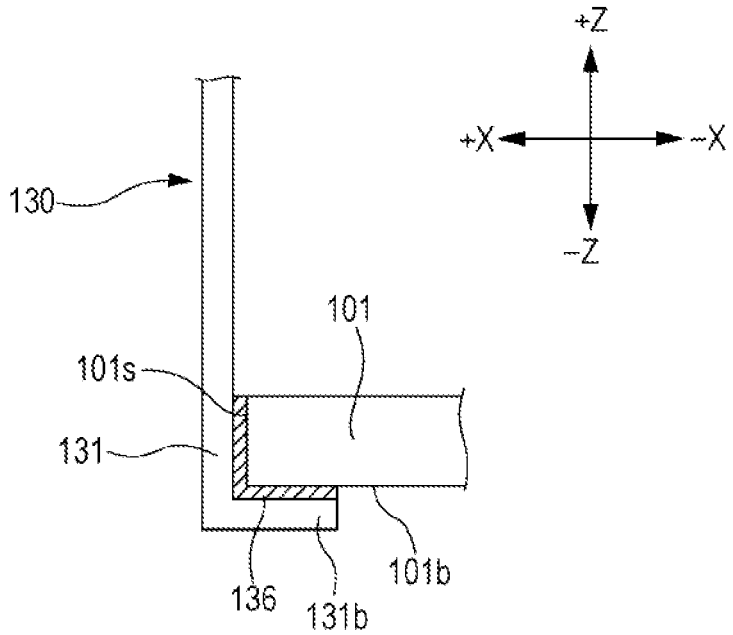
FIG. 10 is a view illustrating a second modification example of the base end portion 131 of the tube holding member 130.

FIG. 10 is a view illustrating a second modification example of the base end portion 131 of the tube holding member 130.

A bent portion 131*b*, which is bent by 90 degrees along a back surface 101*b* from the front surface 101*s* of the paper discharge frame 101, is formed in the base end portion 131 of the tube holding member 130.

The base end portion 131 and the bent portion 131*b* are fixed in close contact to the front surface 101*s* and the back surface 101*b* of the paper discharge frame 101. An adhesive and a two-sided adhesive tape are arranged between the paper discharge frame 101, and the base end portion 131 and the bent portion 131*b*. In this manner, the position of the tip end portion 132 of the tube holding member 130 in the Z direction is accurately determined.

A similar fixing method can also be used for the tube holding members 140, 150, 160, and 170.

[Third Modification Example of Base End Portion]

Figure 11:
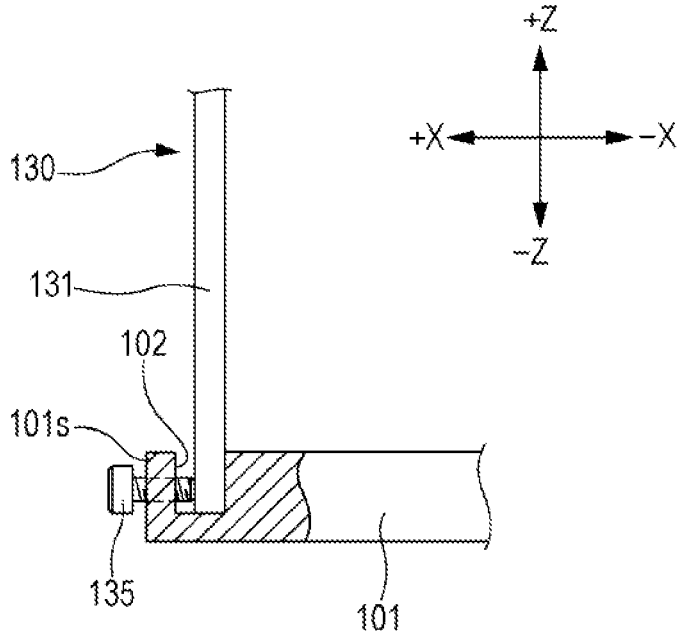
FIG. 11 is a view illustrating a third modification example of the base end portion 131 of the tube holding member 130.

FIG. 11 is a view illustrating a third modification example of the base end portion 131 of the tube holding member 130.

A groove portion 102, which is open in parallel with the Y direction, is formed in the front of an upper surface of the paper discharge frame 101.

The base end portion 131 of the tube holding member 130 is inserted from above into the groove portion 102. Then, the screw 135 that is mounted on the front surface 101*s* of the paper discharge frame 101 is rotated, and the base end portion 131 is pressed against and fixed to a wall surface of the groove portion 102 with a screw tip of the screw 135.

The tube holding member 130 can be adjusted in position in the Y direction along the groove portion 102. The base end portion 131 can be fixed to the paper discharge frame 101 after adjusting the position of the tube holding member 130 into an optimal position.

[Fourth Modification Example of Base End Portion]

Figure 12:
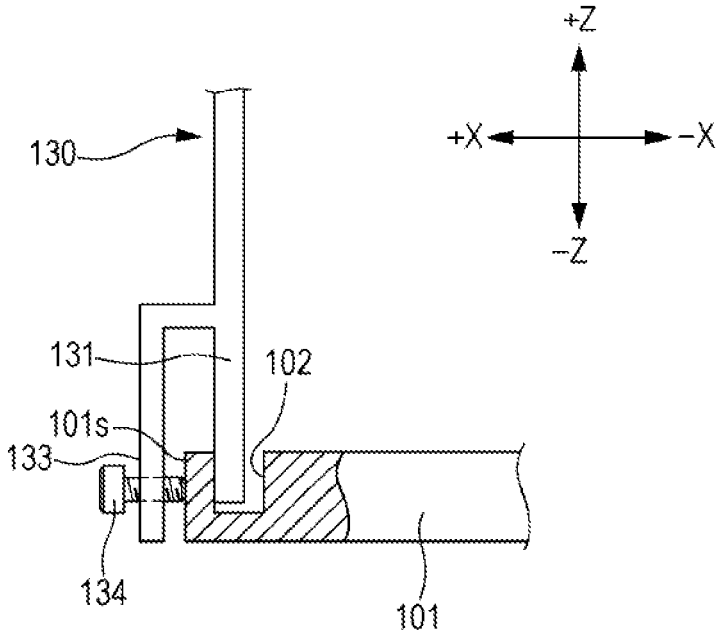
FIG. 12 is a view illustrating a fourth modification example of the base end portion 131 of the tube holding member 130.

FIG. 12 is a view illustrating a fourth modification example of the base end portion 131 of the tube holding member 130.

A second base end portion 133, which is parallel with the base end portion 131, is formed on a front surface side of the base end portion 131 of the tube holding member 130. In addition, a screw hole is formed in the second base end portion 133. Then, a wall portion of the groove portion 102 on the front surface 101*s* side is pinched between a screw tip of a screw 134 inserted into the screw hole and the base end portion 131. In this manner, the tube holding member 130 can be easily fixed to the paper discharge frame 101 without having to form a screw hole in the paper discharge frame 101.

A similar fixing method can also be used for the tube holding members 140, 150, 160, and 170.

The shapes, combinations, and the like of the respective components illustrated in the embodiment described above are an example, and various modifications are possible, based on design requirements and the like, within the scope of the invention.

In an alternative configuration, the ink may be directly supplied from the ink containers 110 via the tube 120 without the ink cartridge adapters 84 being mounted on the carriage 81.

The apparatus that includes the ink containers 110 is not limited to the liquid ejecting apparatus but may be any apparatus that consumes a liquid.

Second Embodiment

A multifunction printer according to a second embodiment of the invention will be described.

Figure 13:
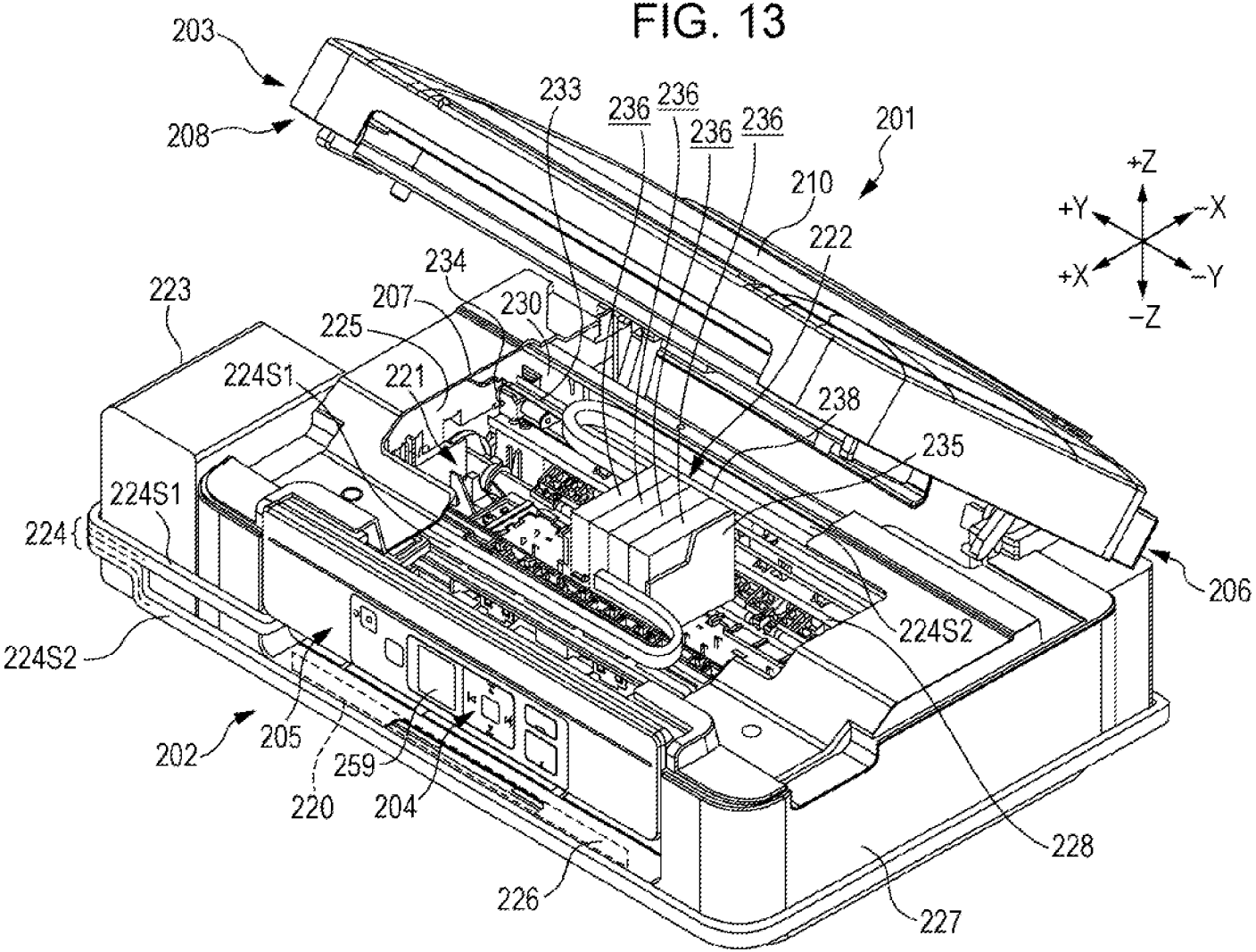
FIG. 13 is an external perspective view of a multifunction printer (at a time when a scanner unit 203 is in an open state) according to a second embodiment.
Figure 14:
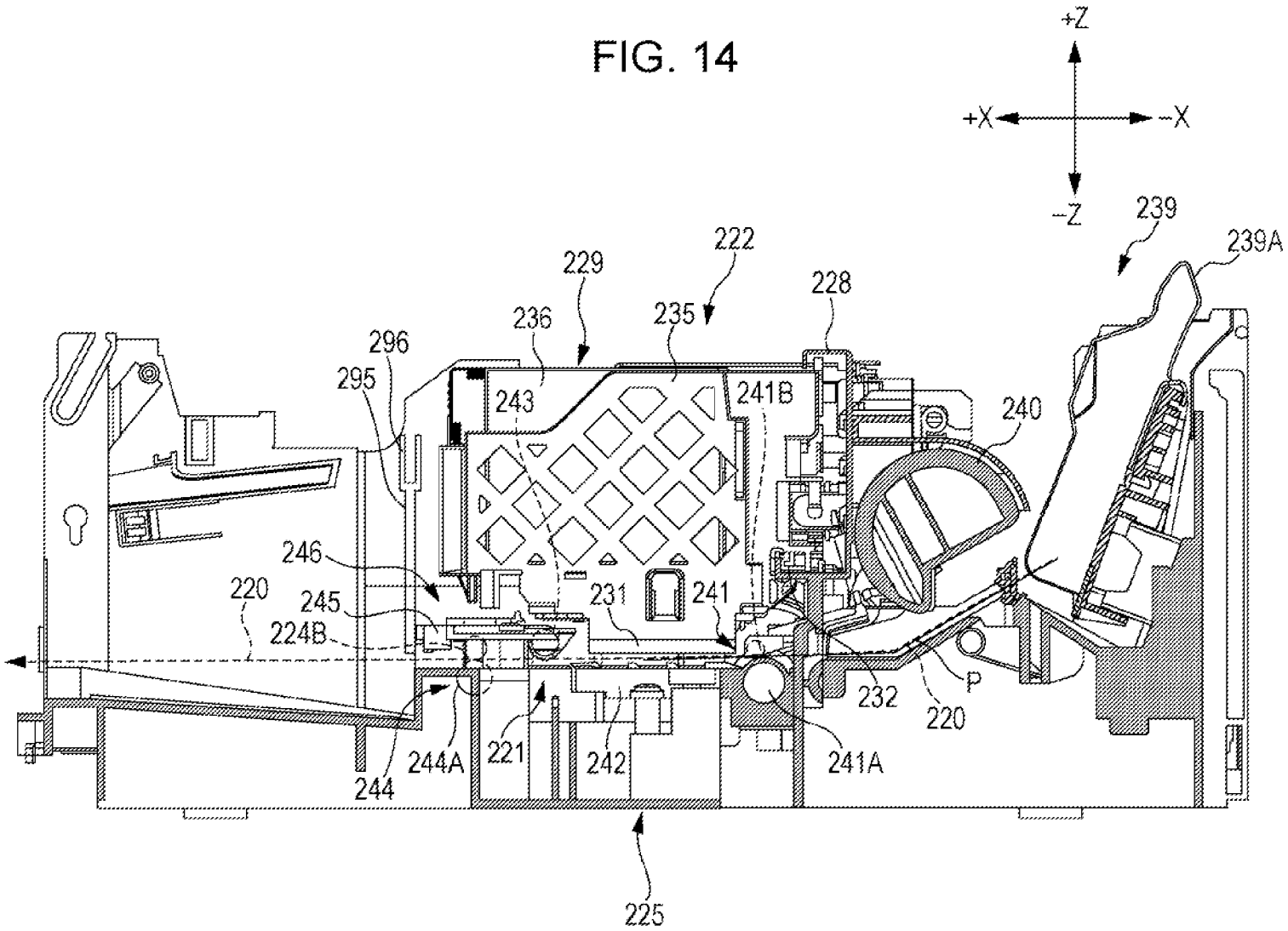
FIG. 14 is a side sectional view illustrating an internal structure of a printer unit 202.

FIG. 13 is an external perspective view of a printer 201 where a scanner unit 203 is in an open state. FIG. 14 is a side sectional view illustrating an internal structure of a printer unit 202. The printer 201 is configured as a so-called multifunction printer that has the scanner unit 203 in addition to the printer unit (image recording device) 202. The scanner unit 203 is arranged in an upper portion of the printer unit 202, and the printer unit 202 and the scanner unit 203 are integrally configured.

An operation panel (panel body) 205, which has a button group 204 that is an operation unit by which both of the units are operated, is disposed on a front surface of the printer unit 202. A liquid crystal display unit 259 that displays setting information and the like is arranged in the operation panel 205. However, the liquid crystal display unit 259 is optional.

The scanner unit 203 is rotatably supported by the printer unit 202 via an opening/closing mechanism 206 in a rear end portion, and covers the upper portion of the printer unit 202 in an openable and closeable manner. In other words, when the scanner unit 203 is lifted in the direction of rotation, an upper surface opening portion 207 of the printer unit 202 is exposed, and an inner portion of the printer unit 202 is exposed via the upper surface opening portion 207.

The upper surface opening portion 207 is closed by the scanner unit 203 when the scanner unit 203 is lowered in the direction of rotation and is mounted on the printer unit 202. A user can have access from the upper surface opening portion 207 to the inner portion of the printer unit 202 by opening the scanner unit 203 and exposing the upper surface opening portion 207, and can perform a treatment such as the prevention of the paper jamming.

An ink tube 224 as a liquid supply tube that supplies the ink from an ink tank 223 to a printing unit 222 is divided into two groups of ink tubes 224S1 and 224S2, and is drawn to an outer portion of a casing of the printer unit 202.

The scanner unit 203 has an upper frame 208 that forms the casing, an image reading unit (not illustrated) that is accommodated in the upper frame 208, and an upper lid 210 that is rotatably supported in the upper portion. The scanner unit 203 has a manuscript table (not illustrated), and an object to be read can be mounted on the manuscript table. The scanner unit 203 has a scanner carriage that has an image sensor, a carriage driving mechanism, a control unit that controls each driving site, and the like (all not illustrated). The image sensor of the scanner carriage is relatively moved, by the carriage driving mechanism subjected to the control by the control unit, with respect to the object to be read which is mounted on the manuscript table. The object to be read is read in this manner.

The printer unit 202 has a transport mechanism 221 that transports a sheet of the recording paper P (printing paper and cut paper) as the recording medium along a transport path 220, the printing unit (recording unit) 222 that is arranged above the transport path 220 and performs the ink jet type printing processing on the recording paper P, the ink tank 223 as a liquid accommodation tank where the ink as a recording liquid which is supplied to the printing unit 222 is stored, the ink tube 224 as the liquid supply tube that supplies the ink from the ink tank 223 to the printing unit 222, the panel type operation panel 205 that is arranged on the front surface, an apparatus frame 225 that is a frame body which supports the transport mechanism 221, the printing unit 222, and the operation panel 205, and an apparatus housing (housing) 227 that is the casing which covers the transport mechanism 221, the printing unit 222, the ink tank 223, the ink tube 224, the operation panel 205, and the apparatus frame 225. An outlet 226 is arranged in the apparatus housing 227. The apparatus frame 225 is arranged in the apparatus housing 227. The ink tank 223 is arranged outside the apparatus housing 227, that is, outside the printer 201. In addition, a USB port (not illustrated) and a power supply port (not illustrated) are arranged in a rear surface lower portion. In other words, the printer 201 is configured to be connectible to a computer and the like via the USB port.

The printing unit 222 has a guide frame 228 formed of a sheet metal that is supported by the apparatus frame 225 and extends in full width in a Y axis direction, a carriage unit 229 that is reciprocally supported by the guide frame 228, and a carriage moving mechanism 230 that allows the carriage unit 229 to reciprocate along the guide frame 228. An ink head 231 as a recording head is mounted on the carriage unit 229.

The guide frame 228 is formed to have a "C"-shaped cross section, and an engaging slider portion 232 of the carriage unit 229 is engaged with the guide frame 228 in upper and lower parts thereof. In this manner, the carriage unit 229 is supported by the guide frame 228 in a hooked and cantilevered manner and reciprocally in a direction of extension (Y axis direction), that is, slidably. The carriage moving mechanism 230 has a timing belt 233 that extends along the guide frame 228, a driving pulley (not illustrated) and a driven pulley 234 across which the timing belt 233 is laid, a connecting/fixing unit (not illustrated) that connects the timing belt 233 to the carriage unit 229 (carriage 235), and a carriage motor (not illustrated) that drives the driving pulley. When the carriage motor is in forward and reverse rotation, the carriage unit 229 reciprocates in the Y axis direction (right-and-left direction) via the timing belt 233. This reciprocation causes the ink head 231 of the carriage unit 229 to be in discharge driving, and the so-called main scanning is performed.

The carriage unit 229 has the box-shaped carriage 235 that is reciprocally supported by the guide frame 228 via the engaging slider portion 232, the ink head 231 that is integrally incorporated into a lower surface of the carriage 235, and four ink storage portions 236 that are mounted on the carriage 235.

The ink tank 223 and the ink storage portions 236 are connected via the ink tube 224, and the ink that is stored in the ink storage portions 236 is supplied to the ink head 231. In other words, the ink in the ink tank 223 is supplied to the ink head 231 via the ink tube 224 and the ink storage portions 236. The ink head 231 has four nozzle columns (not illustrated) that discharge the ink droplets of the four colors.

The ink tank 223 has individual tanks, which correspond to the four nozzle columns, respectively and individually storing the ink of the four colors. The ink tube 224 is configured such that four tube parts (not illustrated) are in parallel, and connects the individual tanks of the ink tank 223 for the respective colors one to one to the respective ink storage portions 236.

The respective ink storage portions 236 are connected one to one to the four nozzle columns of the ink head 231. Accordingly, the ink in the respective individual tanks of the ink tank 223 is supplied to the corresponding nozzle columns of the ink head 231 via the corresponding tube parts and the respective ink storage portions 236.

In the printer 201 according to this embodiment, the supply of the ink from the ink tank 223 to the ink head 231 is performed via the ink storage portions 236. However, the ink tube 224 may be configured to be directly connected to the ink head 231, not via the ink storage portions 236. In addition, the number of the colors of the ink is not limited to four, and may be less than four, or five or more. The number of the ink tubes that constitute the ink tube 224 and the number of the ink storage portions 236 correspond to the number of the colors of the ink. The four nozzle columns of the ink head 231 extend in parallel with each other and in an X axis direction, and are arranged downward, with a predetermined paper gap present, with respect to the recording paper that is fed.

In the carriage unit 229, a flexible flat cable (hereinafter, referred to as FFC) 238 to which the FFC 238 as a signal line is connected connects the ink head 231 to the control unit (not illustrated) that performs driving control on the ink head 231. In addition, the FFC 238 sends information relating to the amount of the ink stored in the ink storage portions 236 to the control unit. A driving control signal is sent from the control unit to the ink head 231 via the FFC 238, and the ink head 231 ejects the ink droplets based on the driving control signal. The FFC 238 is arranged behind the ink head 231, that is, on the side opposite to the side where the outlet 226 is arranged across the carriage 235.

The transport mechanism 221 has a paper tray 239 as a recording medium loading portion where the recording paper P is set in left alignment, a separation roller 240 that feeds out the recording paper P from the paper tray 239 by separating the recording paper P sheet by sheet, a paper feed roller 241 that is positioned on the downstream side of the separation roller 240 and feeds the recording paper P into the printing unit 222 along the transport path 220, a platen 242 that is positioned on the downstream side of the paper feed roller 241 and faces the ink head 231, a serrated guide roller 243 that is positioned on the downstream side of the platen 242, and a paper discharge roller 244 that is positioned on the downstream side of the guide roller 243 and feeds the recording paper P out of the outlet 226. The paper tray 239 has a guide member 239A that guides a left end edge of the recording paper P. Each of the paper feed roller 241, the guide roller 243, and the paper discharge roller 244 is configured as a transport roller that transports the recording paper P, which is separated from the paper tray 239 by the separation roller 240, forward.

The paper feed roller 241 is configured as a nip roller that is formed from a lower side paper feed driving roller 241A and an upper side paper feed driven roller 241B. Likewise, the paper discharge roller 244 is configured as a nip roller that is formed from a lower side paper discharge driving roller 244A and an upper side paper discharge driven roller 244B. In addition, the guide roller 243 and the paper discharge driven roller 244B are supported in a roller frame 245 that is independent of the apparatus frame 225, and constitute a roller assembly 246.

The paper feed roller 241 functions as a main roller that controls the feeding (vertical scanning) of the recording paper, and the paper discharge roller 244 functions as a tension roller that applies tension to the recording paper which is positioned on an upper side of the platen 242.

The recording paper that is fed in from the paper tray 239 by the separation roller 240 is intermittently fed (vertical scanning) forward on the platen 242, by the paper feed roller 241, toward the paper discharge roller 244. In synchronization with the intermittent feeding, the carriage unit 229 selectively discharges the ink (main scanning) while reciprocating in the right-and-left direction to perform the desired printing. The leading edge of the recording paper P that reaches the guide roller 243 beyond the platen 242 is fed into the paper discharge roller 244 with the cambered state corrected by the guide roller 243. When the printing is completed, the recording paper P is fed out forward from the outlet 226 by the paper discharge roller 244 in this manner.

The ink tube 224 may be configured to be held by a tube support rod 295 that is illustrated in FIG. 14. The tube support rod 295 may be configured to be provided in the roller frame 245. When the ink tube 224 is supported from below by the tube support rod 295, the drooping of the ink tube 224 can be suppressed and a collision between the ink tube 224 and a structure in the apparatus housing 227 and a failure in the transport of the recording paper P can be prevented. The tube support rod 295 has a tube holding unit 296 that has a tip end portion which is divided into two. The ink tube 224 is fitted inside the tube holding unit 296, and is held not to fall downward.

A position where the tube support rod 295 supports the ink tube 224 is not particularly limited. However, since the tube support rod 295 is arranged substantially at the center of the width of movement of the carriage 235 in a main scanning direction, a movement of the part of the ink tank 223 resulting from the movement of the carriage 235 is suppressed by the tube support rod 295 of the ink tube 224. In this manner, an irregular movement of the ink tube 224 in an inner portion of the apparatus housing 227 can be prevented.

The liquid ejecting apparatus that ejects the liquid such as the ink has been described as an example of the liquid ejecting apparatus. However, the invention can also be applied to other liquid ejecting apparatuses that eject or discharge a liquid other than ink. Examples of the liquids that can be ejected by the liquid ejecting apparatuses include a liquid in which functional material particles are dispersed or dissolved and a gel type fluid.

The liquid that is ejected from the liquid ejecting apparatus is not limited to the ink, and liquids responding to certain applications can be applied as the liquid that is ejected from the liquid ejecting apparatus.

REFERENCE SIGNS LIST

1 Multifunction printer (liquid ejecting apparatus)
2 Printer unit (liquid ejecting apparatus main body)
10 Upper surface opening portion
66 Groove-shaped concave portion
75 Flexible cable
81 Carriage
83 Ink jet head (liquid ejecting head)
84 Ink cartridge adapter
99 Auxiliary roller (roller)
101 Paper discharge frame (paper discharge frame)
101*s* Front surface
101*b* Back surface
102 Groove portion
110 Ink container (liquid accommodating body)
120 Tube (liquid supply tube)
120F Movable area
121 Tube
125 Tube fastening/fixing tool
130 Tube holding member
131 Base end portion
131*b* Bent portion
132 Tip end portion
140 Tube holding member
142 Tip end portion
150 Tube holding member
152 Tip end portion
160 Tube holding member
161 Base end portion
162 Tip end portion
170 Tube holding member
171 Base end portion
171*h* Extending site
172 Tip end portion
P Recording paper (recording medium)
R Transport path

The invention claimed is:

1. A liquid ejecting apparatus comprising:

a liquid ejecting apparatus main body that ejects a liquid from a liquid ejecting head which is mounted on a carriage toward a recording medium;

a liquid accommodating body that is arranged in an external area of the liquid ejecting apparatus main body; and a plurality of liquid supply tubes that guide the liquid which is fed from the liquid accommodating body where the liquid is accommodated toward the liquid ejecting head and include a deforming movable portion which is deformed in response to the movement of the carriage, a paper feed roller that is disposed upstream of the liquid ejecting head, a paper discharge roller and an auxiliary roller that are disposed downstream of the liquid ejecting head, wherein the liquid ejecting apparatus further comprises a paper discharge frame that is arranged along a scanning direction of the liquid ejecting head on a further downstream side of the recording medium in a transport direction than the liquid ejecting head, wherein the paper discharge frame supports a plurality of the auxiliary rollers that press a surface of the recording medium, and wherein the liquid ejecting apparatus further comprises a tube holding member with a base end portion fixed to the paper discharge frame and a tip end portion where a part of the liquid supply tubes is held.

2. The liquid ejecting apparatus according to claim 1, wherein the liquid supply tubes are formed from a plurality of tubes, and wherein the liquid supply tubes are arranged in a horizontal direction and fastened by the tip end portion.

3. The liquid ejecting apparatus according to claim 1, wherein the liquid supply tubes are formed from a plurality of tubes, and wherein the liquid supply tubes are arranged in a perpendicular direction and fastened by the tip end portion.

4. The liquid ejecting apparatus according to claim 2 or 3, wherein the liquid supply tubes are parallel connection tubes where the plurality of tubes are connected in parallel.

5. The liquid ejecting apparatus according to claim 1, wherein the tip end portion of the tube holding member is formed in parallel with the paper discharge frame.

6. The liquid ejecting apparatus according to claim 1, wherein the base end portion of the tube holding member has an extending site along the paper discharge frame, and wherein the extending site coincides with an end portion of the paper discharge frame.

7. The liquid ejecting apparatus according to claim 1, wherein the paper discharge frame further includes a bottom surface that faces the recording medium and a front surface toward the downstream side in the transport direction, and wherein the base end portion of the tube guide member is fixed to the bottom surface and the front surface of the paper discharge frame.

8. The liquid ejecting apparatus according to claim 1, wherein the paper discharge frame further includes a front surface toward the downstream side in the transport direction, and wherein the base end portion of the tube holding member is formed into a flat plate fixed only to the front surface of the paper discharge frame.

9. The liquid ejecting apparatus according to claim 1, wherein the paper discharge frame further includes a groove portion with an open upper surface, and wherein the base end portion of the tube holding member is accommodated in the groove portion to be movable in the scanning direction.

10. The liquid ejecting apparatus according to claim 9, wherein the base end portion of the tube holding member is pressed against the groove portion and is fixed to the paper discharge frame by a screw which is mounted on the groove portion.

11. The liquid ejecting apparatus according to claim 1, wherein the tube member is disposed in an internal space on the further downstream side of the recording medium in the transport direction than the paper discharge frame.

12. The liquid ejecting apparatus according to claim 1, wherein the liquid supply tubes are fixed in a concave portion that is formed in an upper surface of the liquid ejecting apparatus main body.

13. The liquid ejecting apparatus according to claim 12, wherein a tube fixing member is mounted on the concave portion.

14. The liquid ejecting apparatus according to claim 13, wherein a height position of the tip end portion and the tube fixing member are substantially the same height.

15. A liquid ejecting apparatus comprising:

a liquid ejecting apparatus main body that ejects a liquid from a liquid ejecting head which is mounted on a carriage toward a recording medium;

a liquid accommodating body that is arranged in an external area of the liquid ejecting apparatus main body; and a plurality of liquid supply tubes that guide the liquid which is fed from the liquid accommodating body where the liquid is accommodated toward the liquid ejecting head and include a deforming movable portion which is deformed in response to the movement of the carriage, a paper feed roller is disposed an upstream of the liquid ejecting head, a paper discharge roller and an auxiliary roller that are disposed downstream of the liquid ejecting head, wherein the liquid ejecting apparatus further comprises a paper discharge frame that is arranged along a scanning direction of the liquid ejecting head on a further downstream side of the recording medium in a transport direction than the liquid ejecting head, wherein the paper discharge frame supports a plurality of the auxiliary rollers that press a surface of the recording medium, and wherein the liquid ejecting apparatus further comprises a part of the tube fixed to the paper discharge frame.

16. The liquid ejecting apparatus according to claim 15, wherein the liquid supply tubes are fixed in a concave portion that is formed in an upper surface of the liquid ejecting apparatus main body.

* * * * *